US007302889B2

(12) United States Patent
Schäfer

(10) Patent No.: US 7,302,889 B2
(45) Date of Patent: Dec. 4, 2007

(54) DEVICE FOR HOLDING A DRESSING ON A CYLINDER INCLUDING A HOLDING MEMBER AND BOW IN THE CHANNEL

(75) Inventor: Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 361 days.

(21) Appl. No.: 10/523,989

(22) PCT Filed: Aug. 1, 2003

(86) PCT No.: PCT/DE03/02597

§ 371 (c)(1),
(2), (4) Date: Feb. 9, 2005

(87) PCT Pub. No.: WO2004/024449

PCT Pub. Date: Mar. 25, 2004

(65) Prior Publication Data

US 2006/0005723 A1 Jan. 12, 2006

(30) Foreign Application Priority Data

Aug. 12, 2002 (DE) ..... 102 36 867

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS 4,893,561 A * 1/1990 Grosshauser et al. .... 101/382.1
5,485,784 A * 1/1996 Walschlaeger, Sr. ..... 101/415.1
5,738,012 A * 4/1998 Metrope ..... 101/415.1
6,598,530 B1 7/2003 Schneider et al.
2004/0050276 A1 3/2004 Schafer

FOREIGN PATENT DOCUMENTS

DE 199 24 787 A1 7/2000
DE 100 58 996 C1 6/2002
WO WO 02/43962 A2 6/2002

* cited by examiner

*Primary Examiner*—Leslie J. Evanisko
(74) *Attorney, Agent, or Firm*—Jones, Tullar & Cooper, P.C.

(57) ABSTRACT

At least one dressing, such as a printing forme, is secured to the surface of a cylinder of a rotary printing press by securement devices. These securement devices are arranged in an axially extending channel on the surface of the cylinder. The channel is defined by at least one wall and by an opening directed toward the circumferential surface of the cylinder. At least one wall of the opening extends into the channel at an acute angle with respect to the cylinder circumferential surface. A deflection-resistant retaining device, provided with a first end and with a second end, is pivotably mounted in the channel. The first end holds an angled end of the dressing that is introduced into the channel opening. This first end is disposed remote from a bearing and pivoting point of the retaining device. A dimensionally stable bow, which has a portion that engages the wall of the opening that extends toward the channel at an acute angle, is situated in the channel.

33 Claims, 5 Drawing Sheets

DEVICE FOR HOLDING A DRESSING ON A CYLINDER INCLUDING A HOLDING MEMBER AND BOW IN THE CHANNEL

CROSS-REFERENCE TO RELATED APPLICATIONS

This U.S. patent application is the U.S. national phase, under 35 USC 371, of PCT/DE2003/002597, filed Aug. 1, 2003; published as WO 2004/024449 A1 on Mar. 25, 2004 and claiming priority to DE 102 36 867.3, filed Aug. 12, 2002, the disclosures of which are expressly incorporated herein by reference.

FIELD OF THE INVENTION

The present invention is directed to devices for holding at least one dressing on a cylinder of a rotary printing press, and to a method for mounting these devices. The devices are situated in a cylinder channel that has a wall and an opening oriented toward the surface area of the cylinder.

BACKGROUND OF THE INVENTION

A device for fastening a dressing to be applied on a cylinder, which device is arranged in a channel of a cylinder of a rotary printing press, is known from DE 100 58 996 C1. The device has a one-armed lever and a spring. The lever has a pivot axis which is fixed with place in respect to the cylinder, and the spring is clamped between a wall of the channel and the lever. The channel has an opening, and the lever and the spring are arranged in a base body. The base body is embodied as a tube corresponding to the cross section of the channel, and the lever is pivotably seated in the area of a wall of the base body located opposite the opening of the channel.

In FIG. 2 of the associated WO 02/49362 A2, which corresponds to DE 100 58 996, there is disclosed a device for fastening a dressing to be applied on the cylinder. The lever is pivotably seated in a groove which is cut into the wall of channel. However, this device does not have a base body.

A method and a device for clamping and for releasing flexible plates is known from DE 199 24 787 A1. The device is enclosed in a base body which is arranged in a channel of a cylinder of a printing press. Clamping elements of the device are pivotably seated in supports, which supports are embodied as slits in the base body, and which are engaged by lower ends of the clamping elements. Moreover, the cross section of the channel is matched to the cross section of the base body which is shaped in the form of a groove.

SUMMARY OF THE INVENTION

The object of the present invention is directed to providing devices for holding at least one dressing on a cylinder of a rotary printing press, and to a method for mounting these devices.

In accordance with the present invention, these objects are attained by the provision of at least one dressing end holding device that is situated in a channel of a cylinder of a rotary printing plate. The channel includes an opening to the cylinder surface. One wall of that opening is shaped at an acute angle. The holding device has at least one torsion-resistant holding member with a first end that engages a beveled or angled plate end that is inserted into the channel opening. A second end of the holding member is used to seat the holding device in the channel. A dimensionally-stable bow-shaped member is disposed in the channel and engages the acutely angled channel opening wall. A spring may be used to bias the bow-shaped member away from the holding member when the dressing end holding device is inserted into the cylinder channel.

The advantages to be gained by the present invention consist, in particular, in that the device for fastening a dressing on a cylinder of a rotary printing press, which device consists of a one-armed lever and of a spring, constitutes a structural component which can be easily mounted in a channel of a cylinder. This structural component can be produced in a cost-effective manner. Thus, the attainment of the object of the present invention has the advantage that a base body, which encloses a large portion of the holding device, is not required, which accomplishes a savings in material, and therefore also lowered costs. Devices in accordance with the prior art show tube-shaped bodies which, for all practical purposes, are fitted with their entire surface facing the wall of the channel. For an exact fit of these prior art devices between the channel and the base body, considerably higher demands are made on production technology than are required in connection with the use of a bow in accordance with the present invention which bow, because of its shape, merely needs to be inserted into the channel, and for which bow a single, individual support point is sufficient for accomplishing its function. Advantages in mounting the dressing holding device in accordance with the present invention result because the bow is attached to the holding device, instead of the holding device being loosely placed into the channel. It is particularly advantageous that the bow fixes the holding device or devices in place on its support point, so that the holding device is secured against being unintentionally released from its operating position, and the device, as a whole, is simultaneously arranged in the channel in a manner fixed against relative rotation. When employing a prior art tube-shaped base body, it is necessary to take additional steps for fixing it in place in a manner secure against relative rotation. Moreover, the spring of the subject device, which spreads open the bow and the holding device, can be safely fixed in place at least at one of its ends, which also constitutes an assembly advantage. The spring is linearly guided and is therefore protected against breaking out laterally. By the provision of a stop that can be provided between the bow and the holding device, the spring is prevented from being compressed into a block, in which case the spring would also attempt to yield laterally. Also, the stop advantageously prevents the holding device from jamming an end of the dressing that is suspended, by its leading edge, in the production direction of the cylinder, which jamming would hamper the removal of a dressing wound on the cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
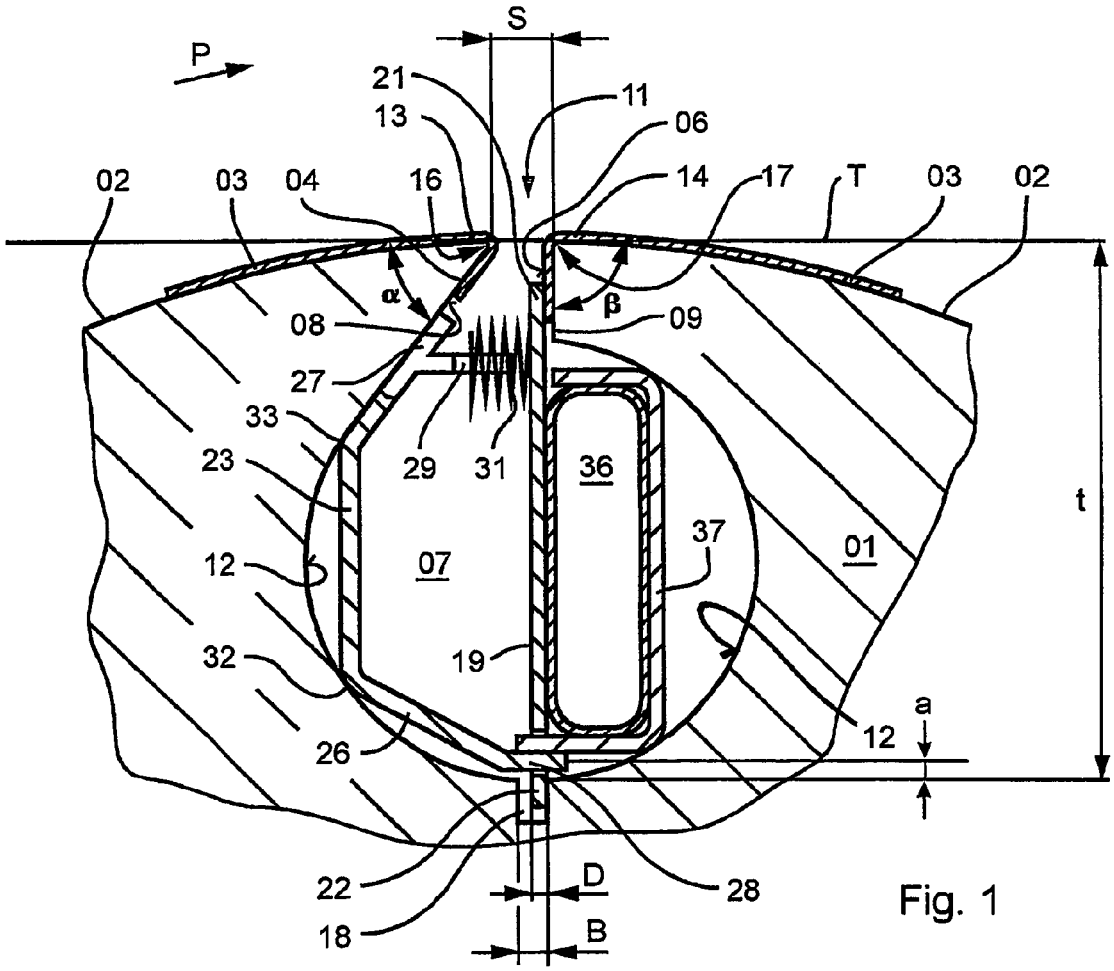
FIG. 1, a cross-sectional representation of a first preferred embodiment of a device for holding a dressing to be applied on a cylinder in accordance with the present invention, in FIG. 2, a perspective representation of the bow portion of the device, in FIG. 3, a planar developed view of the legs of the bow, in FIG. 4, a depiction of a helical spring pushed onto a tongue and with its last winding pulled in, in FIG. 5, a cross-sectional representation of a tongue with a sleeve and a spring, in FIG. 6, a perspective representation of the sleeve of FIG. 5, in FIG. 7, a cross-sectional representation of a second preferred embodiment of a device for holding a dressing to be applied on a cylinder in accordance with the present invention, and in FIG. 8, a perspective representation of elements of the device in accordance with FIG. 7.

In accordance with a first preferred embodiment of the present invention, as represented in FIG. 1, a dressing 03, for example a flexible plate-shaped printing forme 03, is fastened on a circumferential surface area 02 of a cylinder 01 by inserting dressing end legs 04, 06, which legs 04, 06 are beveled or angled off on the ends of the dressing 03, into a channel 07, which is arranged axially extending in the cylinder 01 and which channel 07 has an opening 11 that is oriented towards the surface area 02 of the cylinder 01. The dressing end legs 04, 06 are placed in the opening and bear substantially against spaced walls 08, 09 of the opening 11, which walls 08, 09 are close to the surface area 02 of cylinder 01. The dressing end legs 04, 06 can also rest in part, against an interior wall 12 of the channel 07 which interior wall 12 is located deeper in the interior of the cylinder 01. A border between the walls 08, 09 of the opening 11 and the wall 12 of the channel 07 extends fluidly or seamlessly. By pointing this out, it is only intended to suggest that the insertion depth of the legs 04, 06 is not exactly fixed, but instead encompasses an extended tolerance range. Without having any effect on the present invention, the channel 07 can have various cross-sectional geometries. However, as represented in FIG. 1, a circular cross section is advantageous from the viewpoint of production technology.

Without limiting the present invention only to the following simplified representation, and for the sake of clarity the representation of the present invention takes place in the drawings and discussion in a way as if only a single dressing 03, which is wrapped around the cylinder 01, were to be fastened on the cylinder 01. It is easily comprehensible for one skilled in the art that several dressings could be fastened in accordance with the present invention on the cylinder 01 and spaced in the axial direction of the cylinder, as well as in the cylinder's circumferential direction wherein, however, in the case of several circumferentially spaced dressings, several cylinder channels would also have to be provided in the circumferential direction.

Viewed in the production direction P, as shown in FIG. 1, the dressing 03, to be fastened on the cylinder 01, has a leading end 13 and a trailing end 14, each with beveled-off legs 04, 06, respectively. Viewed in the production direction P of the cylinder 01, the opening 11 of the cylinder channel 07 also has an opening front edge 16, from which edge 06 a wall 08 extends toward the channel 07. This wall 08 is also called a first or front opening wall 08. Opening 11 also has an opening rear edge 17, from which rear edge 17 a wall 09 also extends toward the channel 07, wherein this wall 09 of the opening rear edge 17 is called the second or rear wall 09. The opening 11 is long and narrow and extends axially on the surface area 02 of the cylinder 01 and is therefore embodied to be slit-shaped. A slit width S, in comparison with a depth "t" of the channel 07, which channel depth "t" can be, for example, 28 mm to 35 mm, and preferably 30 mm, is small. Slit width has such dimensions that a leg 04 of a leading end 13 of a dressing 03 and a leg 06 of the trailing end 14 of the dressing 03, or, in the case of several dressings 03 fastened in the circumferential direction of the cylinder 01, that trailing end 14 of an identical dressing 03 can be arranged one behind the other in the opening 11. Slit widths S of less than 5 mm, and preferably in the range of between 1 mm and 3 mm, are advantageous. Therefore, the ratio of the depth "t" of the channel 07 and the slit width S lies approximately at 10:1.

An acute angle $\alpha$, which lies between 40° and 50°, and which is preferably 45°, is formed between the first or front opening wall 08 extending from the opening front edge 16 in the direction toward the channel 07 and an imaginary tangential line T resting on the opening 11 in the surface area 02 of the cylinder 01. Thus, the slit width S of the opening 11 tapers or decreases in the radial cylinder direction toward the surface area 02 of the cylinder 01, and increases in the radial cylinder direction toward the channel 07. The beveled end leg 04 of the leading end 13 of the dressing 03 can be suspended at the front edge 16 of the opening 11, so that this leading dressing end leg 04 rests, preferably in a positively connected manner, against the front opening wall 08 and extending from the opening front edge 16 toward the channel 07. In the preferred embodiment represented in FIG. 1, the second or rear opening wall 09 drops approximately vertically from the rear edge 17 of the opening 11 in the direction toward the channel 07. However, the second or rear opening wall 09 can also be slightly inclined, so that the opening 11 widens in the direction toward the channel 07. An angle $\beta$, which is the opening angle between the wall 09 extending from the rear edge 17 toward the channel 07 and the previously mentioned tangential line T resting on the opening 11 in the surface area 02 of the cylinder 01, lies for example within the range of 85° to 95°, and is preferably 90°.

As a rule, the channel 07 extends in a direction which is axis-parallel with the cylinder 01, and, for example, over the entire length of cylinder 01. A recess 18, for example an axially extending interior groove 18, is located in the wall 12 of the channel 07, and is situated preferably approximately diametrically opposite the slit-shaped opening 11. A preferably dimensionally-stable, torsion-resistant, preferably plate-shaped dressing end leg holding member 19 is placed, preferably loosely, and pivotably. The holding member 19 can be, for example, a metallic strip which is extending linearly in the channel 07, and which is preferably seated in, or on, the bottom of the channel 07. Therefore, the channel interior groove 18 is a seating point and support point of the holding member 19, which is depicted in FIG. 1 as being configured as a lever. In order to allow the holding member 19 to pivot in the groove 18, a width B of the groove 18 is selected to be greater than a thickness D of the holding member 19. The holding member 19 is configured in such a way that it has a first, upper end 21, which can be placed against one of the two walls 08 or 09 of the channel opening 11, and a second, lower end 22 which is located opposite the channel opening 11. This lower end 22 is supported in the groove 18. Alternatively to the provision of the groove 18 in the wall 12 of the channel 07, a holder, which is not specifically depicted, can be provided in the interior of the channel 07 near the wall 12 of the channel 07, in which holder the holding member 19 is pivotable seated. Thus, because of its arrangement and shape, the holding member 19 divides the cross section of the channel 07 into two sections.

A dimensionally-stable bow 23, which is provided with one or with several bow edges or ridges 32, 33 is provided in the channel 07. The bow 23 also has two ends, wherein a first, lower bow leg 26, for example, is oriented from a first bow edge or ridge 32 to a first end of the bow 23, and a second, upper bow leg 27 extends from a second bow edge or ridge 33 to a second end of the bow 23. Thus, the bow 23 is preferably embodied as a polygon and has a substantially semi-circular U- or L-shaped cross section. The bow 23 is arranged in the channel 07, preferably preponderantely only on one side of the holding member 19, namely on that side of holding member 19 which faces the front wall 08 of the opening 11 extending at the acute angle α toward the channel 07. In this case, the bow 23 is advantageously oriented from the second lower end 22 of the holding member 19 to its first upper end 21 wherein, in a preferred embodiment, one end of the bow 23 extends as far as the first or front wall 08 of the opening 11 which extends toward the channel 07 at the acute angle α. The bow 23 is embodied, for example, as a component that may be punched out and bent from sheet metal and which can possibly have several bends. Alternatively, the bow 23 can be a molded element made of plastic. For seating the bow 23 in the channel 07, suitable support points have been formed on the bow 23, for example sharp or rounded edges or flat partial surfaces which are small in comparison with the entire surface of the bow 23. In case of a metallic bow 23, the edges or ridges 32, 33 constitute these bent edges 32, 33, for example.

Figure 2:
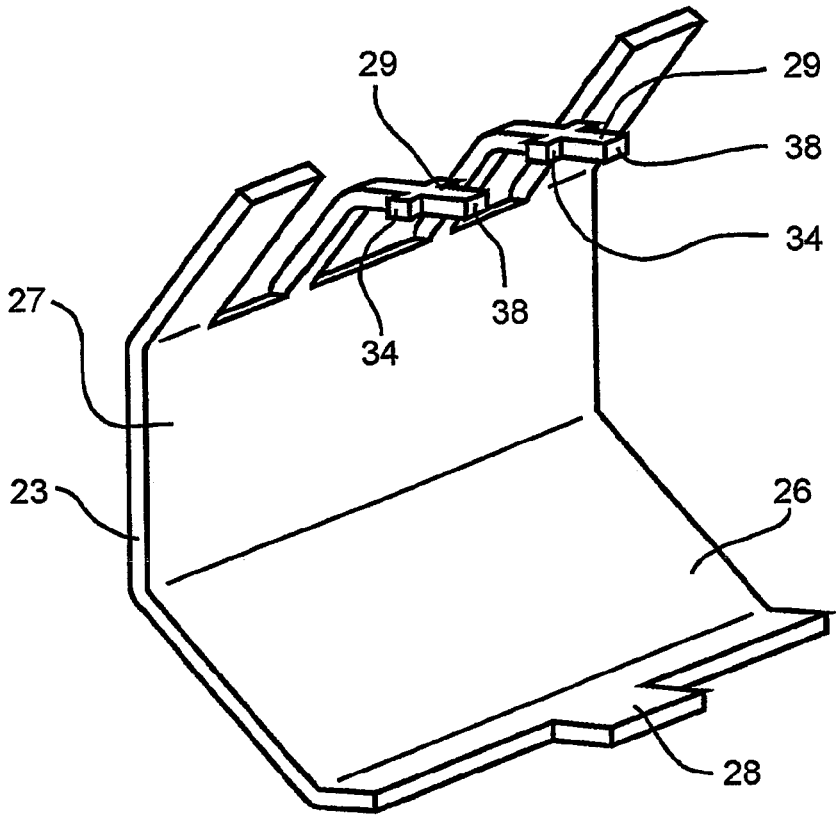
Figure 3:
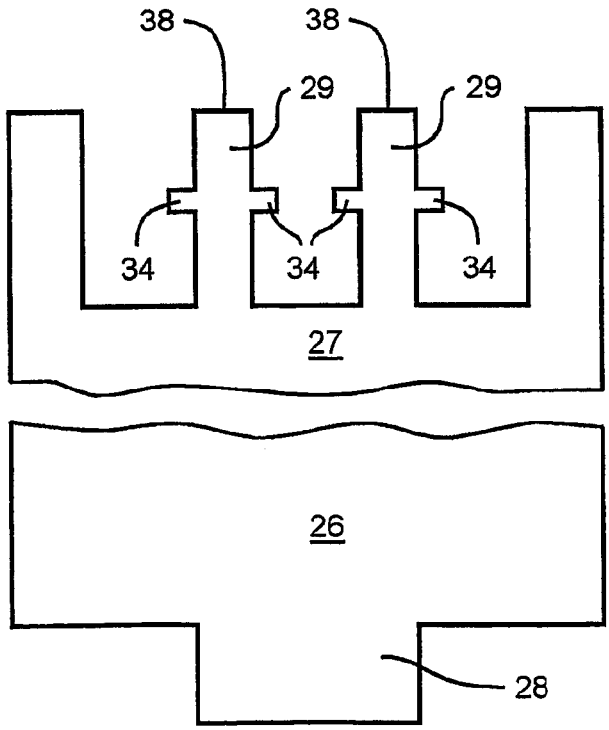

The first, lower leg 26 of the bow 23 is preferably attached to the lower end 22 of the holding member 19. The attachment of the bow lower leg 26 at the lower end 22 of the holding member 19 can be performed, for example, in that at least one opening, for example a bore or a punched-out section, in particular a T-shaped punched-out section, has been applied in the lower end 22 of the holding member 19, in which at least one lower bow tongue 28 formed at the bow lower leg 26, as seen in FIGS. 2 and 3, and in particular a bow tongue 28 that is embodied in a T-shape, can be suspended. A T-shaped embodiment of the punched-out section in the holding member 19 and of the tongue 28 has the advantage that a bow tongue 28 suspended in the holding member 19 can be fixed in place. At least one upper bow tongue 29, or preferably several identical upper bow tongues 29, each oriented toward the first end 21 of the holding member 19, are also formed on the upper leg 27 of the bow 23, on each of which upper bow tongues 29 a spring 31, preferably a helical spring 31, has been placed. The bow 23 is supported in the channel 07 on individual, i.e. spaced apart, support points, preferably at three such spaced support points, wherein one support point is located on the wall 12 of the channel 07 in the upper channel half facing the opening 11 or, in particular, on the wall 08 of the opening 11, which extends at an acute angle α toward the channel 07.

FIG. 1 shows a bow 23 which is supported at individual support points and which thus does not rest, over its entire surface, against the interior wall 12 of the channel 07. The bow 23 is supported by its second upper bow leg 27 on the wall 08 of the opening 11, which wall 08 extends at an acute angle α toward the channel 07, and by an edge or ridge 32 on the wall 12 of the channel 07. Further support points are provided by the front faces of a helical spring 31 which is arranged between the second upper leg 27 of the bow 23 and the first upper end 21 of the holding member 19, as well as by an attachment of the first, lower leg 26 of the bow 23 at the second lower end 22 of the holding member 19. In a preferred embodiment, the support point of the bow 23 at the second lower end 22 of the holding member 19 is spaced apart from the seating and center point of the holding member 19 by a distance "a," wherein the distance "a" is a few millimeters, preferably between 1 mm and 3 mm. The support point of the bow 23 with the first bow edge or ridge 32 at the wall 12 of the channel 07, as represented in FIG. 1, is optional, because three support points are sufficient for the secure seating of the bow 23 in the channel 07. Use of the support point on the wall 08 of the opening 11, which extends at an acute angle α toward the channel 07, offers the advantage of fixing the holding member 19 in its seating and center point by use of the bow 23. Here, the seating of the bow 23 in the channel 07 is disengaged from a pivot movement of the holding member 19.

The spring 31, which has preferably been placed on the upper bow tongue 29, is pre-stressed and spreads the bow 23 and the holding member 19 apart. Therefore, the spring 31 is supported, at one end, on the bow 23, and, on its other end, on the holding member 19, preferably close to the upper end 21 of the holding member 19, so that the holding member 19, acting as a lever, forms as long a lever arm as possible between its seating point in the groove 18 up to the spring 31. The support of the spring 31 on the bow 23 can be aided by the provision of one or of several bow upper tongue strips 34, as seen in FIGS. 2 and 3 formed on the side of the bow upper tongue 29, or by an appropriately embodied stop-like collar 34. The upper, second bent edge or ridge 33 of the bow 23, or its upper leg 27, are advantageously supported near or on the wall 08 extending from the opening front edge 16 toward the channel 07. The force exerted by the spring 31, which is arranged between the bow 23 and the holding member 19, on the bow 23, as well as on the holding member 19, together with the support of the bow 23 on the wall 08 of the opening 11, which extends at an acute angle α toward the channel 07, aids the fixation, in place, of the holding member 19 in its seating and center point in the groove 18. The upper end 21 of the holding member 19 is also simultaneously pushed against the second opening wall 09 extending toward the rear edge 17 of the opening 11, from which engagement a clamping point results at the first, upper edge 21 of the holding member 19, which clamping point is used for fastening of a beveled end leg 06 of a dressing 03 suspended there.

The holding member 19, the bow 23 and the spring 31 constitute a structural unit, which can be mounted, in a simple manner, in a channel 07 of the cylinder 01, preferably by being inserted laterally into the channel 07. Therefore, a method for mounting into a cylinder 01 of a rotary printing press, a device for fastening at least one dressing 03 on the cylinder 01, and wherein the device is arranged in a channel 07 of the cylinder 01, is substantially distinguished by the process steps in which a spring 31 is placed on an upper tongue 29 of a bow 23, a lower leg 26 of the bow 23 is movably attached to a lower end 22 of a holding member 19, and the holding member 19, together with the bow 23 and the spring 31 are introduced into the channel 07. Moreover, in connection with this method, a support 37 of an actuating member 36, which is used for actuating the holding member 19, can be movably attached to the holding member 19, prior to the insertion of the holding member 19 into the channel 07. Through their combined effects, the holding member 19, the bow 23 and the spring 31 constitute a device, which is effective in the channel 07, for fastening a dressing 03 to be placed on a cylinder 01 of a rotary printing press.

The actuating member 36 counteracts the contact pressure exerted by the spring 31, via the holding member 19 upper end 21 on the second opening wall 09 extending from the rear edge 17 of the opening 11 in order to release, when required, the clamping caused by the holding member 19 at the wall 09 during an actuation of the actuating member 36. The actuating member 36 is preferably a hose 36 that is extending in the longitudinal direction of the channel 07, and which can be charged with a pressure medium, such as, for example, compressed air, and which can be enclosed in an actuating member support 37. The support 37 of this actuating member 36 can be a sheet metal element which is bent in a U-shape, for example, which is supported on the wall 12 of the channel 07 and which, by its shape, reduces the amount of an increase in the volume of the hose 36 which is required for releasing the clamping force and in this way contributes to a shorter reaction time of the actuating member 36. The actuating member support 37 can also be suspended by a tongue that is formed on the support 37 and which may be received in at least one opening of the holding member 19, for example in a bore or in a punched-out section. This suspension of the actuating member support 37 can also take place in the same, correspondingly larger embodied, opening of the holding member 19 in which, for example, the lower leg 26 of the bow 23 is also suspended, so that the tongue of the actuating member support 37 and the tongue 28 on the lower leg 26 of the bow 23 come to rest on each other. As with the suspension of the bow 23, an actuating member support 37, which is suspended from the holding member 19, should also remain movable transversely in respect to the holding member 19 in order to be able to support the actuating member support 37 on the wall 12 of the channel 07, at least during the actuation of the actuating member 36. Embodiments can also be advantageous, wherein the actuating member 36 and its support 37 are embodied as a single component. A hollow body, which is configured to be reversibly deformable, for example as a hose which can be charged with a pressure medium, is reinforced, in addition to the side facing the holding member 19, for example by being extrusion-coated with plastic, so at least one, preferably metallic, tongue for the suspension of the actuating member support 37, whose material is incorporated into the material of the actuating member 36, in an opening of the holding means 19, has been introduced into this reinforced outer wall of the actuating member 36. With a different configuration of the actuating member 36, an actuating member support 37 in the form herein described may be unnecessary. A further preferred embodiment provides for the embodiment of the actuating member support 37 in the form of a strip extending in an axial direction over the entire length of the channel 07. The support may be fastened, for example by a screw connection, on the front or end faces of the cylinder. In this case, the strip is advantageously embodied in such a way that it can be threaded into the channel 07 through the slit-shaped opening 11, or can be moved out of channel 07 by a rotary movement around an axis parallel with the cylinder.

Figure 4:
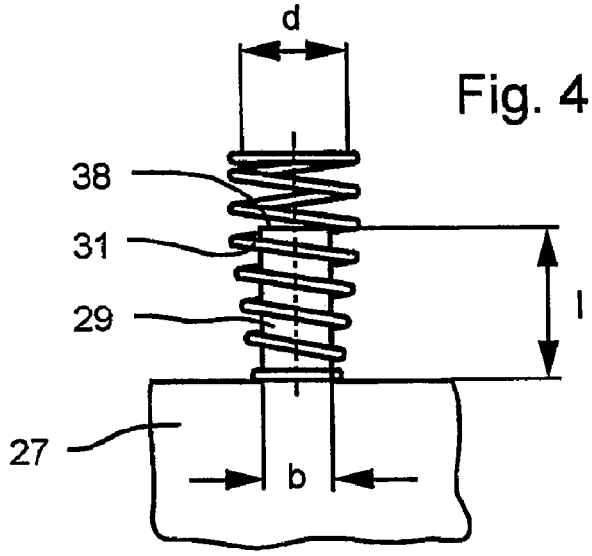

FIG. 4 shows a preferred configuration of the spring 31 which is placed on the upper bow tongue 29 which is formed on the upper leg 27 of the bow 23. So that spring 31 will be fixed in place on the upper bow tongue 29, in this depicted configuration the spring 31 has a pulled-in or reduced diameter last winding, with which the spring 31 is matched to the width "b" of the upper bow tongue 29. Spring 31 can be placed on the tongue 29 by a press fit. The width "b" of the tongue 29 may be, for example, between 3 mm to 10 mm, and is preferably 5 mm. The length "l" of the tongue 29 can lie between 6 mm and 15 mm, for example. The interior diameter "d" of a spring 31, with a pulled-in or reduced diameter last winding, widens over the length "l" of the tongue 29. An interior diameter "d" at the spring end, with which the spring 31 is supported on the holding member 19 is, for example, approximately 1 mm greater than the width "b" of the tongue 29. Therefore the rise or extension of the spring 31 is unimpeded. In a preferred embodiment, an end face 38 of the upper bow tongue 29 is used as a stop 38 for limiting a pivoting movement of the holding member 19 between the bow 23 and the holding member 19, wherein the pivoting movement of the holding member 19 is oriented toward the bow 23. The stop 38 prevents the helical spring 31, arranged between the bow 23 and the holding member 19 from being fully compressed into a block.

Figure 5:
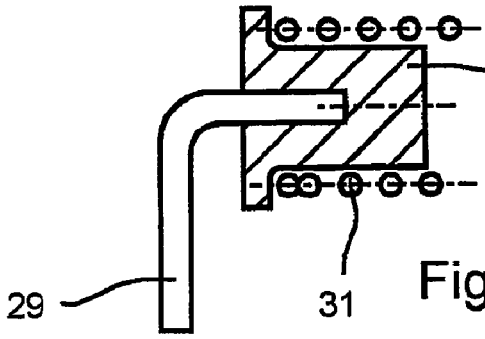
Figure 6:
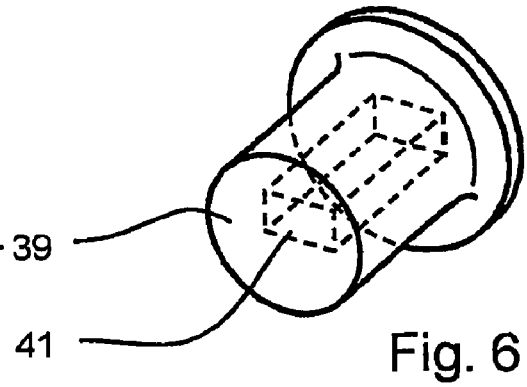

A further embodiment of an arrangement of the spring 31 on the upper bow tongue 29 is shown in FIGS. 5 and 6. A sleeve 39, which is preferably made of plastic, has a bore 41 or a blind bore 41, by the use of which the sleeve 39 can be pushed onto the upper bow tongue 29. Alternatively, such a sleeve 39 can be applied directly to the upper leg 27 of the bow 23, which has been shaped to match. The spring 31 itself is pushed onto the sleeve 39. A front face of the sleeve 39, in turn, limits the lift or extension of the spring 31.

Figure 7:
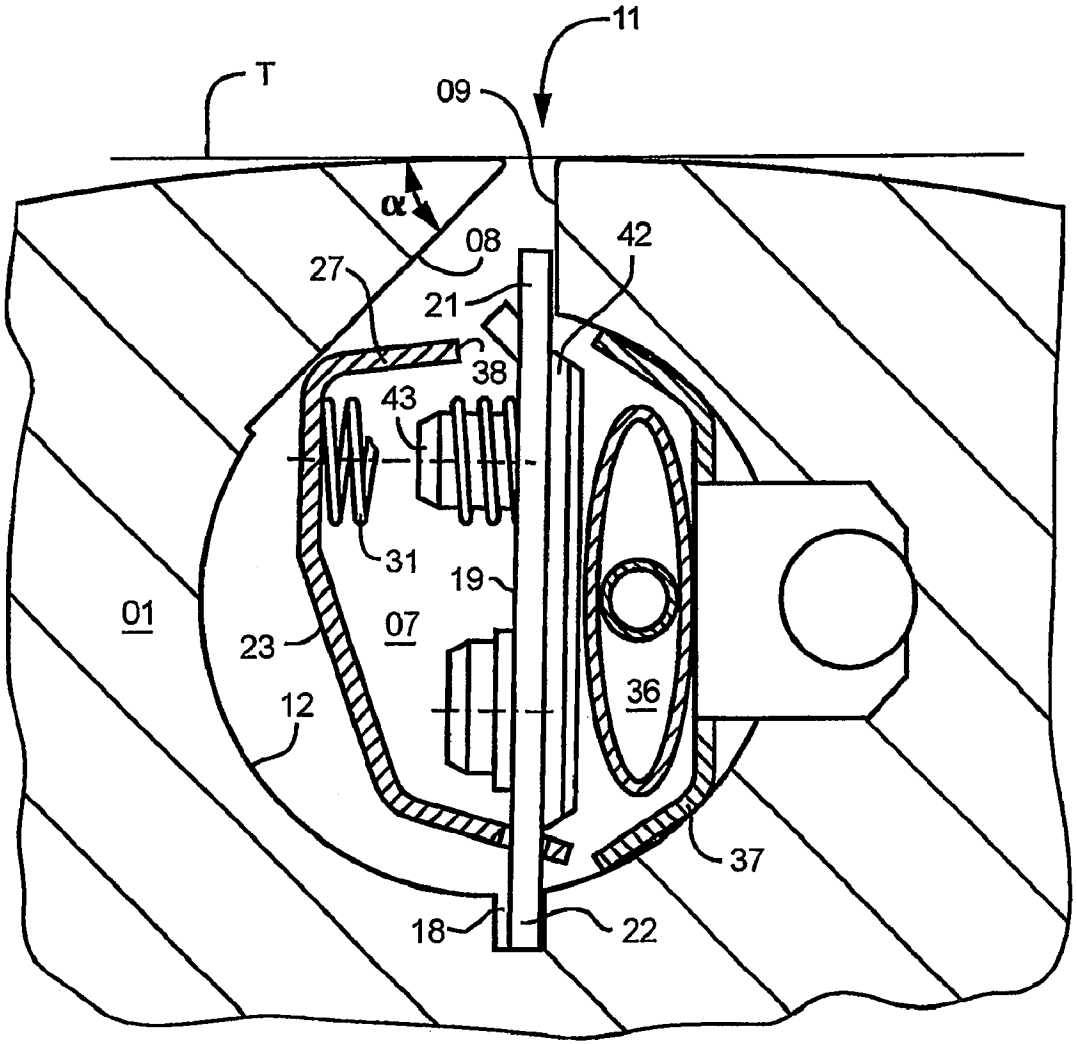

A further preferred embodiment of the device in accordance with the present invention is represented in FIG. 7. The bow 23, which, in particular, is a dimensionally-stable bow 23 made of a metallic material, is supported near one of its ends at the front opening wall 08 of the opening 11, which extends at an acute angle $\alpha$ toward the channel 07, and also with its other end at the second, lower end 22 of the holding member 19. A spring 31 is arranged between the bow 23 and the holding member 19 substantially parallel with a tangential line T resting on the opening 11. Spring 31 spreads the bow 23 and the holding member 19 apart, so that the spring 31 exerts a force on the respective support points of the bow 23 and contributes to a fixing of the holding member 19 in place in its seating and centering point in the groove 18. The spring 31 is preferably configured as a helical spring 31. For the sake of clarity, the spring 31 is represented in FIG. 7 with an interrupted winding. The spring 31 has been placed on a peg 43, wherein the peg 43 is preferably formed on a peg plate 42, and the peg plate 42 is attached to the side of the holding member 19 facing away from the bow 23.

Figure 8:
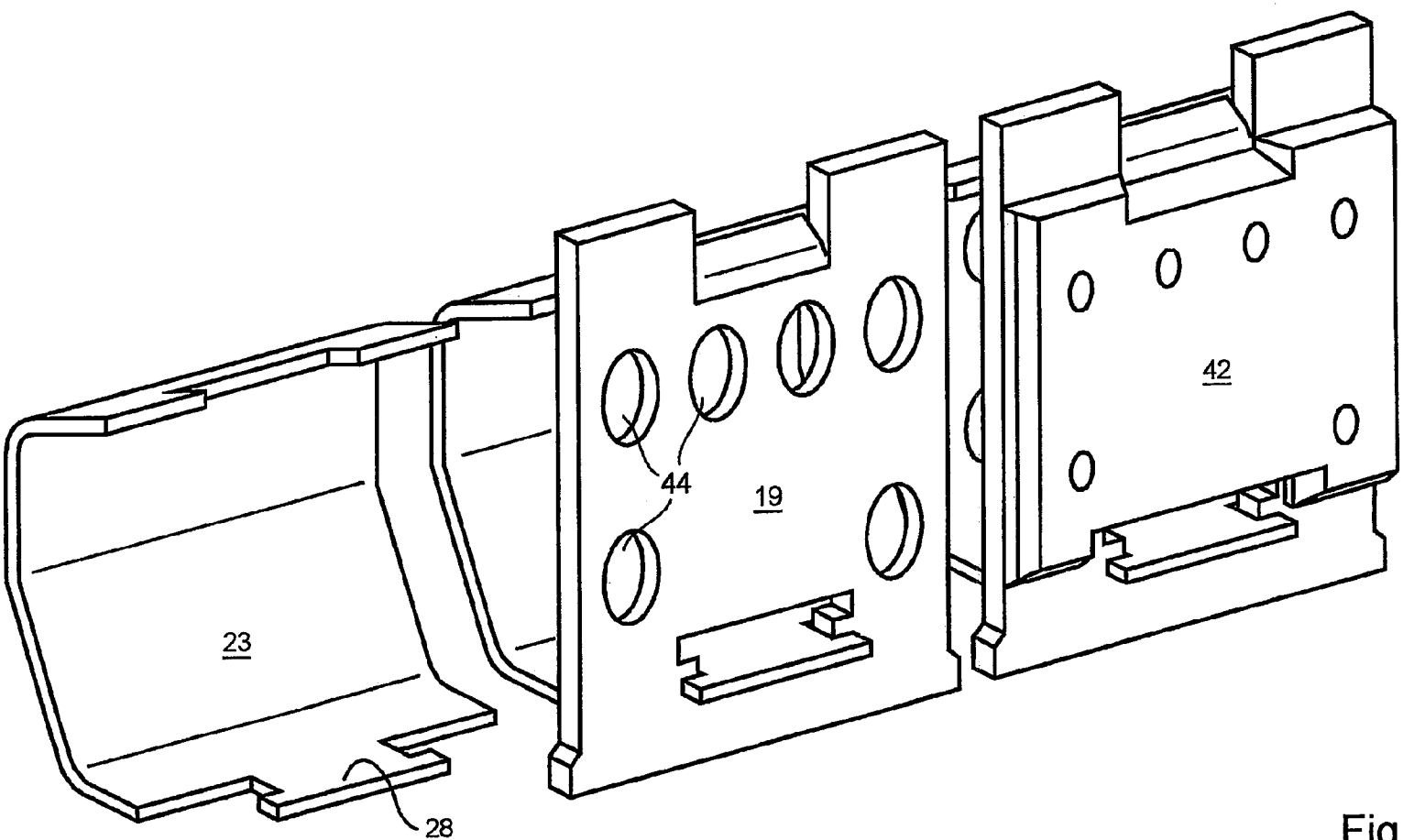

FIG. 8 shows further details of this preferred embodiment. For example, the holding member 19 has at least one opening 44, but advantageously has a plurality of openings 44, into which a peg 43 attached to the peg plate 42, for example formed on it, can be clipped. The peg plate 42 is fastened to the holding member 19 by the pegs 43 that are clipped into the openings 44. The spring 31 has been advantageously pushed onto at least one of the pegs 43. On its one, lower end, by which it is attached to the holding member 19, the bow 23 advantageously has a lower bow tongue 28 embodied in a T-shape, which is suspended in an opening, preferably also embodied in a T-shape, of the holding member 19. This configuration of the lower bow tongue 28 and the opening in the holding member 19 permits a rotatorily movable seating of the bow 23 on the holding member 19, but which also secures the bow 23 against an unintentional removal from the holding member 19. By the use of the rotatorily movable seating, with generous play, of the bow 23 in the holding member 19, the bow 23 remains unaffected, to a large extent, by a pivot movement of the holding member 19. Advantageously the peg plate 42 attached to the holding member 19 is configured in such a way that, following its attachment to the holding member 19, it covers the opening, embodied in a T-shape, in the holding member 19 to such an extent, that the lower bow tongue 28, which is embodied in a T-shape, on the bow 23 can no longer be removed from the holding member 19. In this way, the peg plate 42 additionally secures the bow 23 against unintentional removal from the holding member 19. The peg plate 42 can be made of a plastic material, for example. In the course of its actuation, the actuating member 36, which is arranged in the channel 07, exerts a force on an actuating member support 37, which is fixed in place in the channel 07 and which is preferably embodied in the shape of a shell, as well as on the peg plate 42 that is attached to the holding member 19. The actuating member support 37 is embodied, for example, as a strip that is fastened to the front or end faces of the cylinder 01.

From the support point of the bow 23 on the wall 08 of the opening 11, which extends at an acute angle $\alpha$ toward the channel 07, an upper leg 27 of the bow 23 is oriented toward the holding member 19. In this preferred embodiment, the front or free end face 38 of the leg 27 constitutes a stop 38, against which the holding member 19 strikes during a pivot movement that is triggered by actuation of the actuating member 36 and which is directed toward the bow 23.

While preferred embodiments of devices for holding at least one dressing on a cylinder of a rotary press and methods for mounting such devices, in accordance with the present invention, have been set forth fully and completely hereinabove, it will be apparent to one of skill in the art that various changes in, for example the overall size of the cylinder, drive assemblies for the cylinder, and the like could be made without departing from the true spirit and scope of the present invention which is accordingly to be limited only by the following claims.

What is claimed is:

1. A device for holding at least one dressing on a cylinder of a rotary printing press comprising:

a cylinder channel having a channel wall and an opening oriented toward a cylinder surface area;

at least one torsion-resistant holding member seated for pivotal movement in said channel and having a first end and a second end, said first end being adapted to hold a beveled end leg of a dressing inserted in said opening;

a seating and center point of said holding member arranged on said second end; and a dimensionally stable bow in said channel and connected to said holding member; said bow having a first bow leg on a first bow end and a second bow leg on a second bow end, said first bow leg being movably supported in said holding member second end.

2. The device of claim 1 further including a supporting point on said bow spaced from said holding member, said seating and center point of said holding member being located adjacent said channel wall.

3. The device of claim 2 further including an opening wall extending at an acute angle from a tangent line of said opening and extending toward said channel wall.

4. The device of claim 3 further including at least one additional supporting point on said bow and engageable with one of said channel wall and said opening wall.

5. The device of claim 4, further comprising another additional supporting point located at said holding member.

6. The device of claim 5 wherein said another additional supporting point is located at said second end of said holding member.

7. The device of claim 1 further including an opening wall extending at an acute angle from a tangent line of said opening and extending toward said channel wall.

8. The device of claim 7 wherein said bow is supported on said opening wall.

9. The device of claim 1 further including a stop in said channel between said holding member and said bow, said stop being adapted to limit pivotal movement of said holding member toward said bow.

10. The device of claim 1 including at least three individual support points on said bow.

11. The device of claim 10 further including a spring interposed between said holding member and said bow, at least one of said three individual support points being located in a direction of a line of force of said spring.

12. The device of claim 11 wherein said spring is located adjacent said holding member first end.

13. The device of claim 1 wherein said seating and center point of said holding member is located diametrically opposite said channel opening.

14. The device of claim 1 wherein said holding member is a strip.

15. The device of claim 1 wherein said bow is one of a sheet metal element and a plastic molded part.

16. The device of claim 1 further including at least one tongue on said second bow leg and a spring arranged on said tongue between said holding member and said bow.

17. The device of claim 16 further including a positive connection between said tongue and said spring.

18. The device of claim 16 further including at least one strip on said tongue.

19. The device of claim 16 further including a sleeve on said tongue.

20. The device of claim 19 further including a tongue receiving bore in said sleeve.

21. The device of claim 16 wherein said at least one tongue is a stop adapted to limit pivoting movement of said holding member toward said bow.

22. The device of claim 1 further including an opening in said holding member, said first bow leg being received in said opening.

23. The device of claim 1 further including an actuating means in said channel and adapted to move said holding member.

24. The device of claim 23 further including an actuating means support.

25. The device of claim 24 wherein said support for said actuating means is an axially extending strip in said channel and extending the length of said channel.

26. The device of claim 25 wherein said support at least partially encloses said actuating means and includes at least one support tongue receivable in a corresponding opening in said holding member.

27. The device of claim 24 wherein said support is integral with said actuating means except at a side of said actuating means engageable with said holding member.

28. The device of claim 1 wherein said bow is supported in said channel fixed against pivotal movement.

29. The device of claim 1 wherein said bow has a bow end oriented toward said holding member first end.

30. The device of claim 1 wherein said bow extends from said holding member second end to said channel wall.

31. The device of claim 1 wherein said second end of said holding member is situated adjacent said channel wall.

32. The device of claim 1 further including a spring interposed between said holding member and said bow, said spring being adapted to fix said holding member in place in said channel.

33. The device of claim 32 wherein said spring is positioned adjacent said first end of said holding member.

* * * * *